United States Patent [19]

Sheth et al.

[11] Patent Number: 4,529,177

[45] Date of Patent: Jul. 16, 1985

[54] TRANSFORMER CORE MANDREL

[75] Inventors: Dilitkumar R. Sheth, Succasunna; Kevin J. Durand, Summit, both of N.J.

[73] Assignee: Allied Corporation, Morris Township, Morris County, N.J.

[21] Appl. No.: 420,180

[22] Filed: Sep. 20, 1982

[51] Int. Cl.[3] ..... C21D 3/00

[52] U.S. Cl. ..... 266/274; 29/605; 242/118.4; 336/213

[58] Field of Search ..... 242/118.4, 118.6, 118.7, 242/118.8; 266/274; 336/213

[56] References Cited

U.S. PATENT DOCUMENTS

| | | | |
|---|---|---|---|
| 2,313,306 | 3/1943 | Wiegand | 336/213 |
| 2,404,237 | 7/1946 | Krizsan | 242/118.6 |
| 2,643,828 | 6/1953 | Vincent | 242/118.4 |
| 3,218,592 | 11/1965 | Barrick | 242/118.4 |
| 3,329,374 | 7/1967 | Stanton | 242/118.4 |
| 3,503,275 | 3/1970 | Morse | 242/118.4 |
| 3,940,085 | 2/1976 | Campbell | 242/118.4 |
| 4,068,808 | 1/1978 | King | 242/118.4 |

*Primary Examiner*—John P. Sheehan

*Attorney, Agent, or Firm*—Paul Y. Yee; Gerhard H. Fuchs

[57] ABSTRACT

The invention provides a method and apparatus for spirally winding a magnetic core from at least one filament of magnetic material. Two congruent mandrel plates are mated together in facing relation to delimit a mandrel having an outer peripheral edge portion. An annular channel is formed in the edge portion to delimit at least one channel region having a preselected characteristic width dimension, and a plurality of graduated templates are optionally disposed about the mandrel edge portion to delimit at least one template region having a preselected characteristic width dimension. Filamentary magnetic material is then wound about the mandrel to fill the channel regions and any template regions, thereby producing the core.

8 Claims, 14 Drawing Figures

FIG. 1
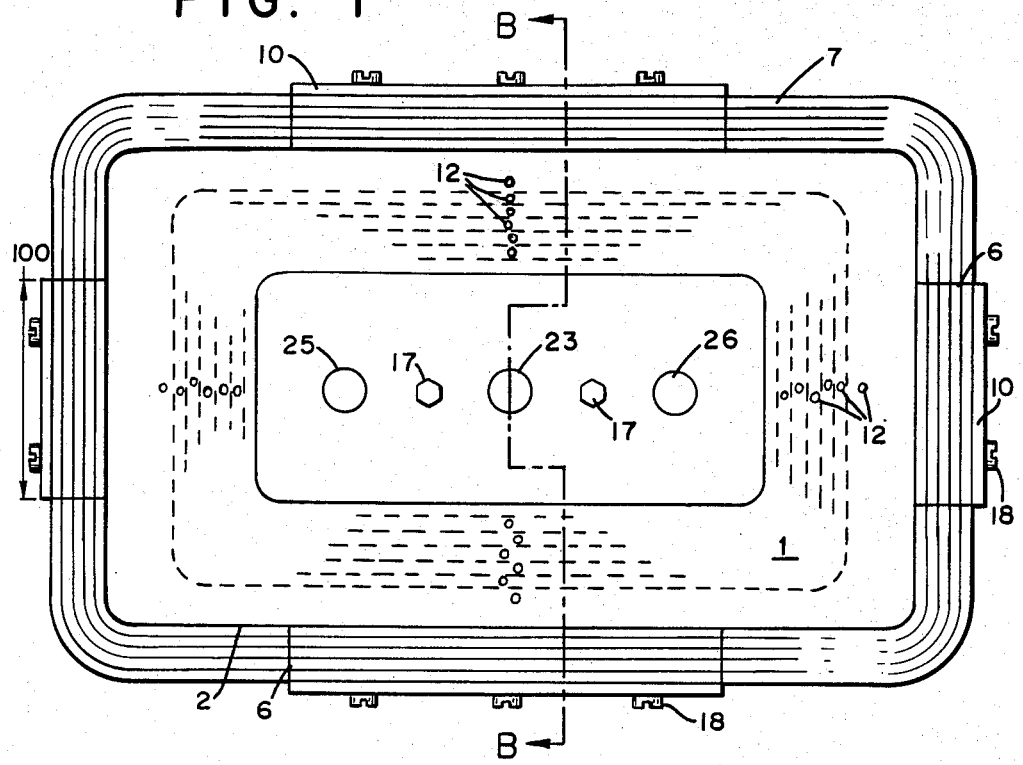
FIG. 3C
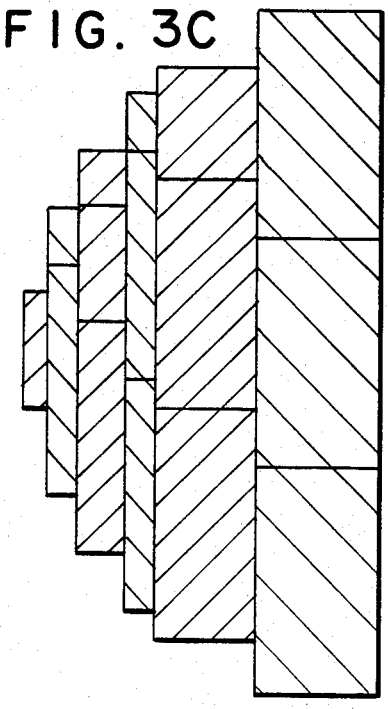
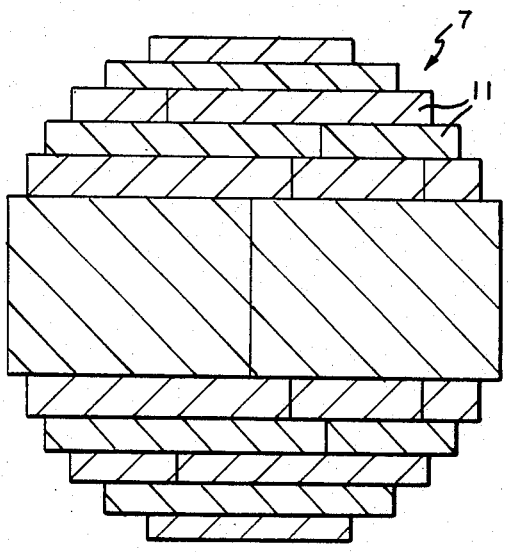
FIG. 4C

TEMPERATURE (CELSIUS)
400
300
200
100
325
375
365
FURNACE
CORE CENTER
1 2 3 4 5 6 7 8 9 10 11 12 13 14
TIME (HOURS)

TEMPERATURE (CELSIUS)
400
300
200
100
325
375
365
FURNACE
CORE CENTER
1 2 3 4 5 6 7 8 9 10 11 12 13 14
TIME (HOURS)

TRANSFORMER CORE MANDREL

BACKGROUND OF THE INVENTION

1. Field of the Invention

The invention relates to a method and apparatus for spirally winding a magnetic core from at least one filament of magnetic material. More particularly, the invention relates to a method and apparatus for winding a transformer core from at least one filament of magnetic material composed of a glassy metal alloy.

2. Description of the Prior Art

When manufacturing a power transformer core using conventional magnetic material, the core has ordinarily been comprised of individual sheets of material which have been cast or stamped into a preselected planform shape. The formed sheets are laminated to build up the thickness of magnetic material needed to provide a core body of the desired configuration.

Glassy metal magnetic alloys are especially desirable for use in transformer cores because of their improved magnetic characteristics such as high permeability, low core power loss, and low VA (volt-ampere) characteristics. Glassy metal magnetic alloys, however, are tougher and harder than conventional crystalline magnetic alloy materials, and cannot be easily stamped or cut to form the required shapes. In addition, such alloys are necessarily produced in thin strips or ribbons because of the rapid quench rates needed to develop amorphous, glassy metal structures. As a result, the most efficient means of building up a core body is by spirally winding a filament of magnetic material into successive, multiple laminations. Since the filaments of glassy metal alloys are generally less than six centimeters wide, multiple, individually wound core elements are needed to build up the material volume needed to produce the desired cross-sectional shapes for larger transformer cores wider than six centimeters. In addition, glassy metals generally have a low coefficient of friction and mated surfaces slide easily over one another. Therefore, it has been difficult to prevent relative motion between the multiple, juxtaposed wound elements, which can distort the core configuration during and after the winding operation. The core distortions, in turn, induce undesired stresses that degrade the magnetic characteristics. Thus, due to the particular physical characteristics of glassy metal magnetic alloys, conventional methods and apparatus have produced distorted power transformer cores with degraded magnetic characteristics.

SUMMARY OF THE INVENTION

The invention provides an apparatus for spirally winding a magnetic core, such as a power transformer core, from at least one filament of magnetic material. The apparatus constrains the wound filamentary material into a core body having a selected cross-sectional shape. Generally stated, the apparatus includes two congruent mandrel plates, mated together in facing relation to each other, to form a split mandrel having an outer peripheral edge portion. An annular channel formed in the edge portion delimits at least one channel region having a preselected, characteristic width dimension. In a particular embodiment of the invention, a plurality of graduated templates, disposed about the edge portion, delimit at least one template region having a preselected, characteristic width dimension.

The invention also provides a method for forming a magnetic core from filamentary magnetic material. Filamentary magnetic material is spirally wound around the periphery of a mandrel, and the wound filament is constrained thereon to produce a magnetic core having a preselected planform and cross-sectional shape. To adapt the method to form a multiple loop magnetic core, filamentary magnetic material is spirally wound around the peripheries of a plurality of mandrels. The wound filament on each of the mandrels is constrained to produce complementary cores having preselected planform and cross-sectional shapes. Then, the complementary cores are mated along complementary edge portions thereof to form a multiple loop core configuration. The formed core is annealed, preferably in a magnetic field, and then removed from the mandrel.

The apparatus of the invention provides a rigid structure which accurately locates and constrains the multiple, juxtaposed, wound elements needed to build up a sufficient volume of material to produce a power transformer core. The device can be adapted to produce cores having various cross sectional configurations by changing the contour of the channel and the contour of the region defined by the templates. The split mandrel configuration allows easy removal of the wound core while still preserving the core shape. Thus, the invention provides an apparatus and method for the production of power transformer cores which, unlike conventional devices and techniques, can be used to produce transformer cores wound from filamentary material, particularly filaments composed of glassy metal alloy.

BRIEF DESCRIPTION OF THE DRAWINGS

The invention will be more fully understood and further advantages will become apparent when reference is made to the following description of the preferred embodiment of the invention and the accompanying drawings in which:

FIG. 1 is a top plan view of a magnetic core wound about the apparatus of the invention;

DESCRIPTION OF THE PREFERRED EMBODIMENTS

Figure 2:
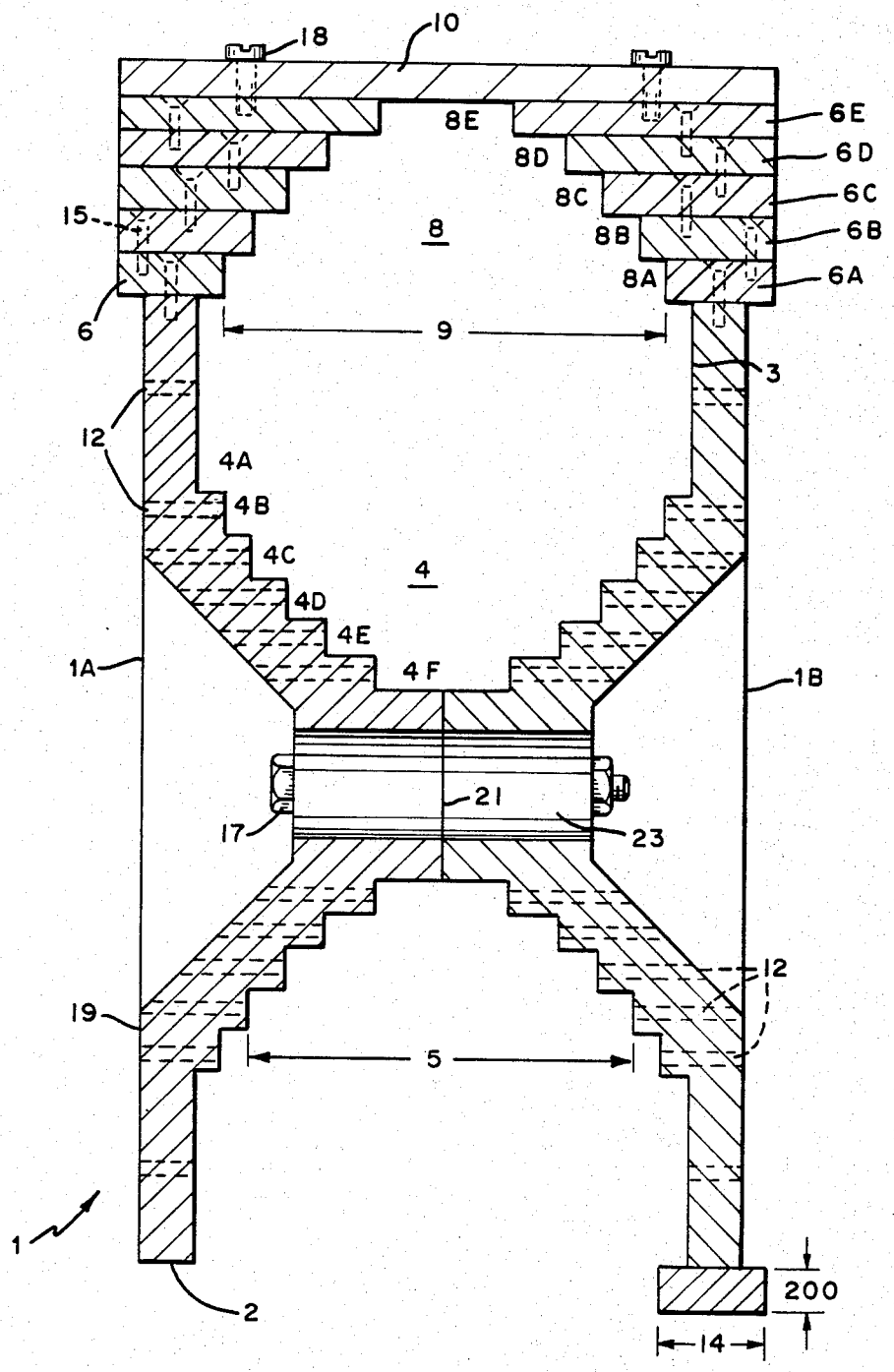
FIG. 2 is an enlarged cross-sectional view of the apparatus taken along line B—B of FIG. 1.

The apparatus and method of the invention can be used to wind magnetic cores of various types. For example, the invention is suitable for winding cores for signal transformers, inductors, filter reactors and the like. While the particular embodiments of the invention shown and described are adapted to wind a power transformer core, it is readily apparent that the invention is suited for these other applications as well, all of which fall within the scope of the invention.

For the purposes of the invention and as used in the specification and claims, the term "filament" is a slender body the transverse dimensions of which are much smaller than the length. Thus, a filament includes wire, ribbon, sheet and the like having regular or irregular cross-section.

The apparatus of the invention provides a fixturing device for spirally winding a magnetic core from at least one filament of magnetic material such as FeNi and FeSi. Preferably, the core is wound from filamentary glassy metal magnetic material. Such glassy metal is prepared by cooling a melt of the desired composition at a rate of at least about $10^4$° C. per second, employing metal quenching techniques well known to the glassy metal alloy art; see, e.g., U.S. Pat. No. 3,856,513 to Chen, et al. The purity of all compositions is that found in normal commercial practice.

A variety of techniques are available for fabricating continuous filament. Typically, a particular composition is selected, powders or granules of the requisite elements in the desired portions are melted and homogenized, and the molten alloy is rapidly quenched on a chill surface, such as a rapidly rotating metal cylinder.

Under these quenching conditions a metastable, homogeneous, ductile material is obtained. The metastable material may be glassy, in which case there is no long range order. X-ray defraction patterns of glassy metal alloys show only a defuse halo, similar to that observed for inorganic oxide glasses. Such glassy alloys must be at least 50% glassy to be sufficiently ductile to permit subsequent handling such as winding to form magnetic cores. Preferably, the glassy metal must be at least 80% glassy to attain superior ductility.

The metastable phase may also be a solid solution to the constituent elements. In the case of the filament used in the present invention, such metastable, solid solution phases are not ordinarily produced under conventional processing techniques employed in the art of fabricating crystalline magnetic materials. X-ray defraction patterns of the solid solution show the sharp defraction peaks characteristic of crystalline alloys, with some broadening of the peaks due to desired fine grained size of crystallite. Such metastable materials ae also ductile when produced under the conditions described above.

Glassy metal magnetic alloys which can be used with the invention consist essentially of a composition, in atom percent, defined by the formula $M_aY_bZ_c$, where M is at least one metal selected from the group consisting of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent.

Referring to FIGS. 1 and 2 of the drawings, there is illustrated the fixturing device of the invention. Split mandrel 1 is comprised of two congruent mandrel plates, 1A and 1B, one being the mirror image of the other, mated in facing relation to each other to define an annular outer peripheral edge portion 2. Annular channel 3 is formed in edge portion 2 to delimit at least one channel region 4 which has a characteristic width dimension 5. FIGS. 1 and 2 also illustrate a particular embodiment of the invention wherein a plurality of templates 6 are disposed about edge portion 2 to delimit at least one template region 8 having a characteristic width dimension 9.

In a preferred embodiment, the mandrel plates include press-out means, such as press-out holes 12, for preserving the core configuration during the removal of the mandrel from the wound core. The contoured cross-sectional shape of channel 3 is symmetrical about the mating line 21 between mandrel plates 1A and 1B and delimits successive channel regions 4A, B, C, D, E, and F located at successively greater depths into edge portion 2. The characteristic width dimensions 5 of each channel region respectively decreases by a preselected increment in correspondence with the successively greater depth at which each successive channel region is located into edge portion 2. In a second preferred embodiment, a plurality of graduated templates 6A, B, C, D, E are placed about edge portion 2 in complementary pairs which face each other across the mating line between mandrel plates 1A and 1B. The templates are located at successively greater radial distances from edge portion 2 to delimit successive template regions 8A, B, C, D, E which have width dimensions that respectively decrease in correspondence with the successively greater radial distance at which each successive template region is located from edge portion 2.

In the shown embodiments, mandrel plates 1A and 1B are rectangular shaped with rounded corners, and are made of a suitable material such as stainless steel. Being mirror images of each other, the plates match closely when mated together in facing relation and cooperate to form peripheral edge portion 2. Suitable fastening means, such as bolts 17 hold the mated plates together to form split mandrel 1. Mandrel 1 has a central mounting hole 23 formed therethrough which provides a positioning means for mounting the mandrel on a core winder apparatus, and has aperture holes 25 and 26 extending therethrough which are configured to accomodate a magnetic induction means. In addition, press-out holes 12 extend through the mandrel plates to accomodate the insertion of press-out rods which provide push-out means that contact the wound core elements located thereunder to maintain the core cross-sectional shape when the mandrel is removed from the core.

Annular channel 3 is formed into edge portion 2 by a suitable forming method, such as machining. Preferably, channel 3 is contoured to produce a transformer core having a preselected shape. In the shown embodiment, the cross-sectional configuration of channel 3 has a distinct stepped appearance to delimit a series of rectangularly shaped channel regions 4A, B, C, D, E and F located at successively greater depths into edge portion 2. Region 4A has a preselected width and is machined into edge portion 2 to a preselected depth. Channel region 4B has a smaller width and is machined deeper into edge portion 2. Similarly, channel portions 4C, D, E and F have successively smaller widths and are machined at successively greater depths into edge portion 2.

It is readily apparent that channel 3 formed in mandrel plates 1A and 1B could be formed by various methods, all of which are within the scope of the invention.

For example, a contoured peripheral groove could be machined about the edge of each individual plate with the groove extending into one face portion of the plate. The groove is contoured and configured such that when the mandrel plates are mated together along the grooved faces, the mated mandrel plates delimit a channel region having the desired cross-sectional configuration.

In a particular embodiment of the invention, a plurality of graduated templates 6A, B, C, D and E are placed about mandel 1 in complementary pairs which face each other across the mating line 21 between the plates. In this embodiment, the templates are substantially flat, rectangularly shaped plate members having preselected lengths and composed of a suitable material such as metal or plastic. The width dimensions 14 of the templates are graduated in preselected increments as needed to create rectangularly shaped template regions 8A, B, C, D and E which are located at successively greater radial distances from edge portion 2. The thickness dimensions 200 of the templates are selected as required to provide the desired heights to the template regions. Templates 6A are connected to mandrel 1 with suitable fastening means such as screws 13. Succeeding templates 6B, C, D, E then connect serially, stacked on top of one another, with each one fastened to its respective preceding template with suitable fastening means, such as screws 15. After core 7 is wound about mandrel 1 filling channel 3 and filling template regions 8, a cap plate 10 may be fastened over the last of the series of stacked templates 6 bridging the distance between the facing template stacks.

To wind a core, mandrel plates 1A and 1B are bolted together to form mandrel 1 and mounted on a core winder. Filamentary magnetic material is then wound about the mandrel to fill channel region 4F. If the filament width is less than the width of channel region 4F, several filaments are spirally wound about mandrel plates to produce separate juxtaposed stacks or core elements 11 as required to fill channel region 4F. Similarly, additional filaments are spirally wound about mandrel 1 and the previously wound core elements to produce juxtaposed core elements which fill channel regions 4E, 4D, 4C, 4B, and 4A.

Figure 3A:
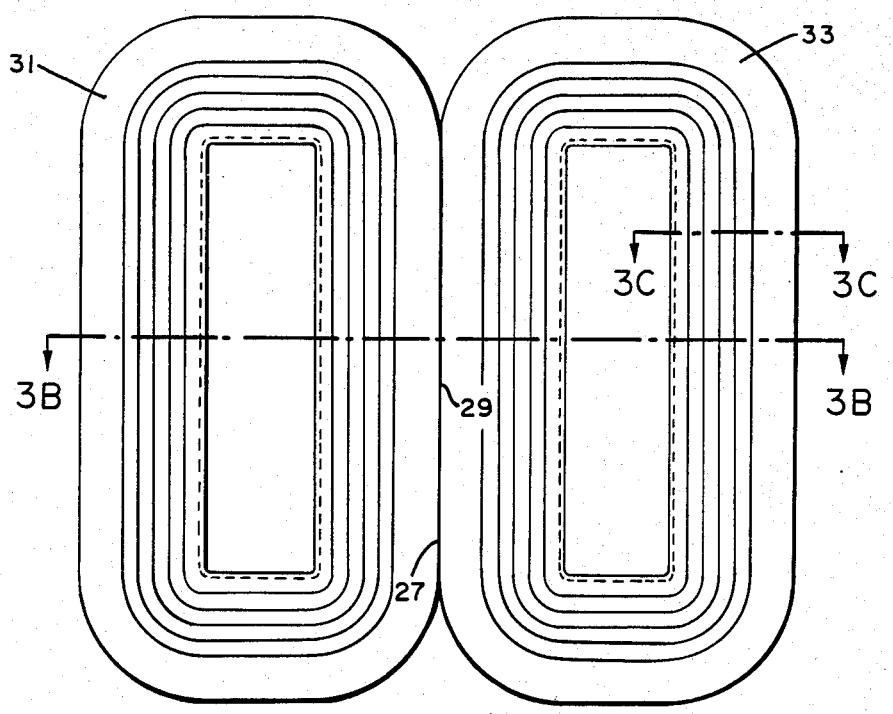
FIG. 3A, B and C show a plan view and cross-sectional views of a magnetic core having a multiple loop configuration.
Figure 3B:
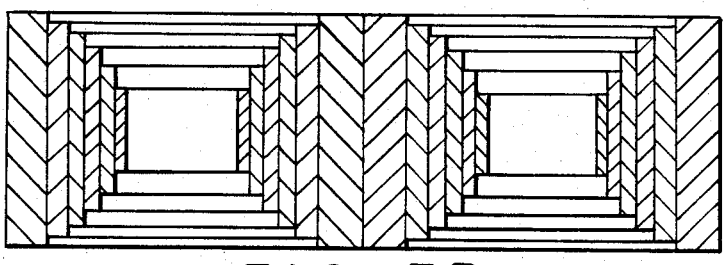
Figure 6:
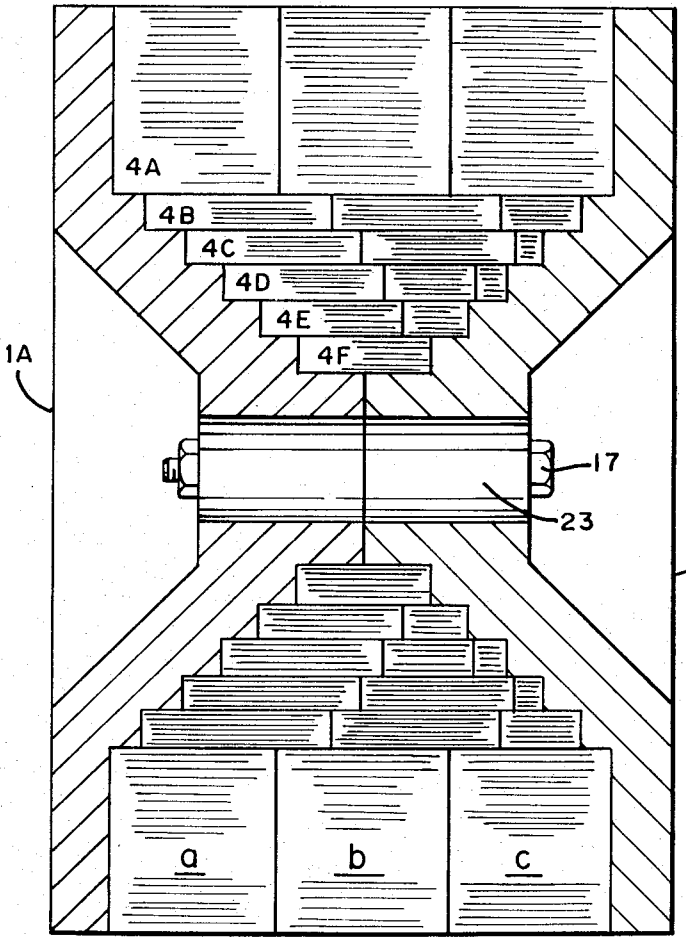
FIG. 6 is a cross-sectional view of a mandrel without templates about which multiple, juxtaposed core elements have been wound.

When all the channel regions are filled with magnetic material, as illustrated by FIG. 6, the wound core can be used to produce various different core configurations. For example, multiple complementary cores 31 and 33, each wound on a separate split mandrel in accordance with the invention, can be mated together along complementary edge portions thereof, such as edge faces 27 and 29 as representatively shown in FIG. 3, to produce a power transformer core having a multiple loop configuration.

Figure 4B:
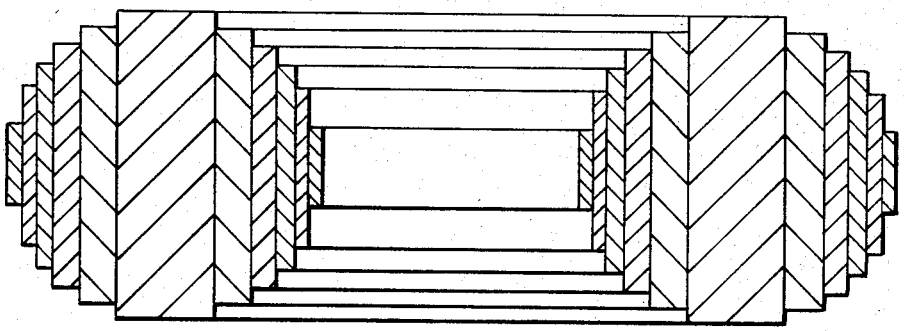
FIGS. 4A, B and C show a plan view and cross-sectional views of a magnetic core having a single loop configuration.
Figure 4A:
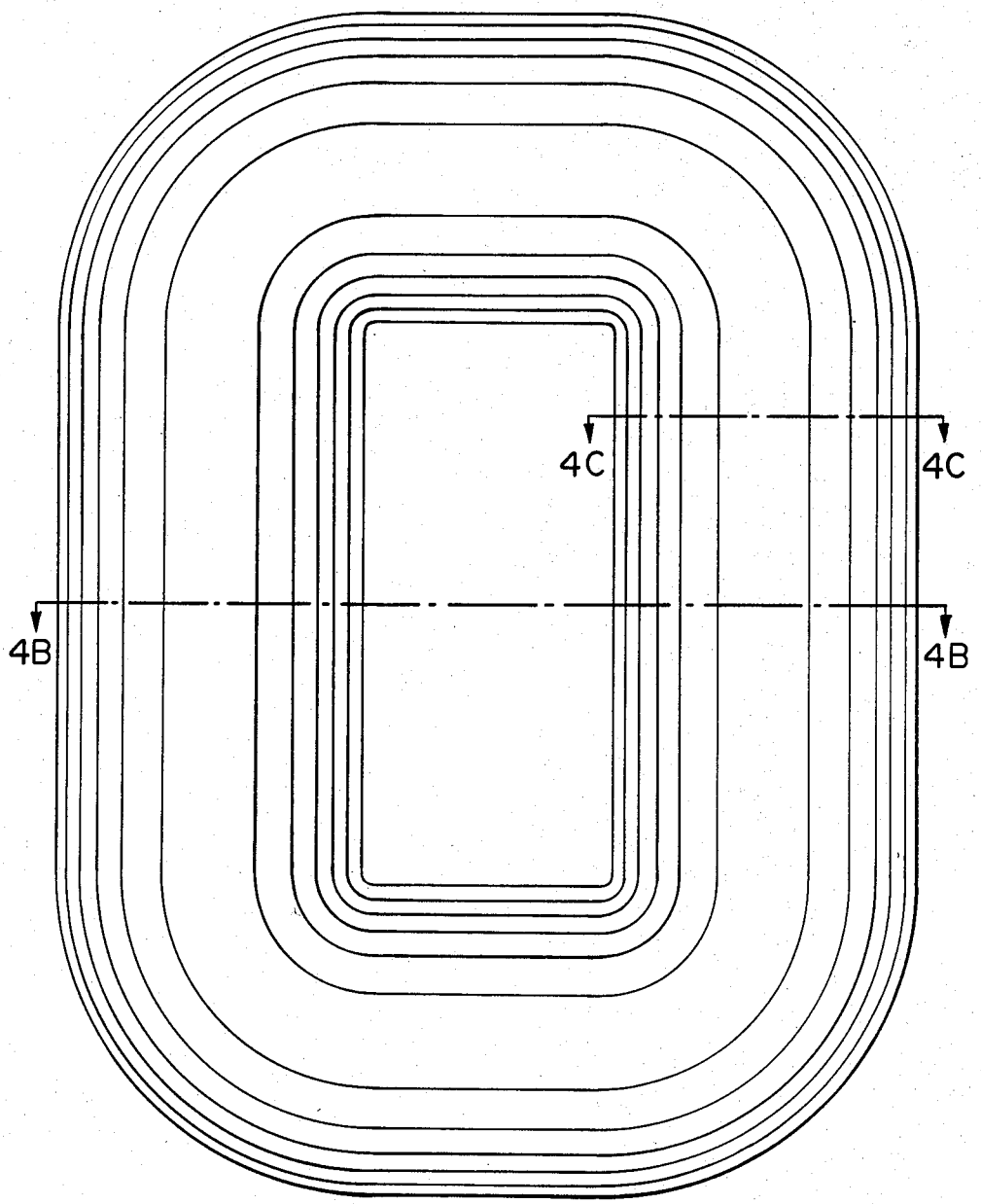
Figure 5:
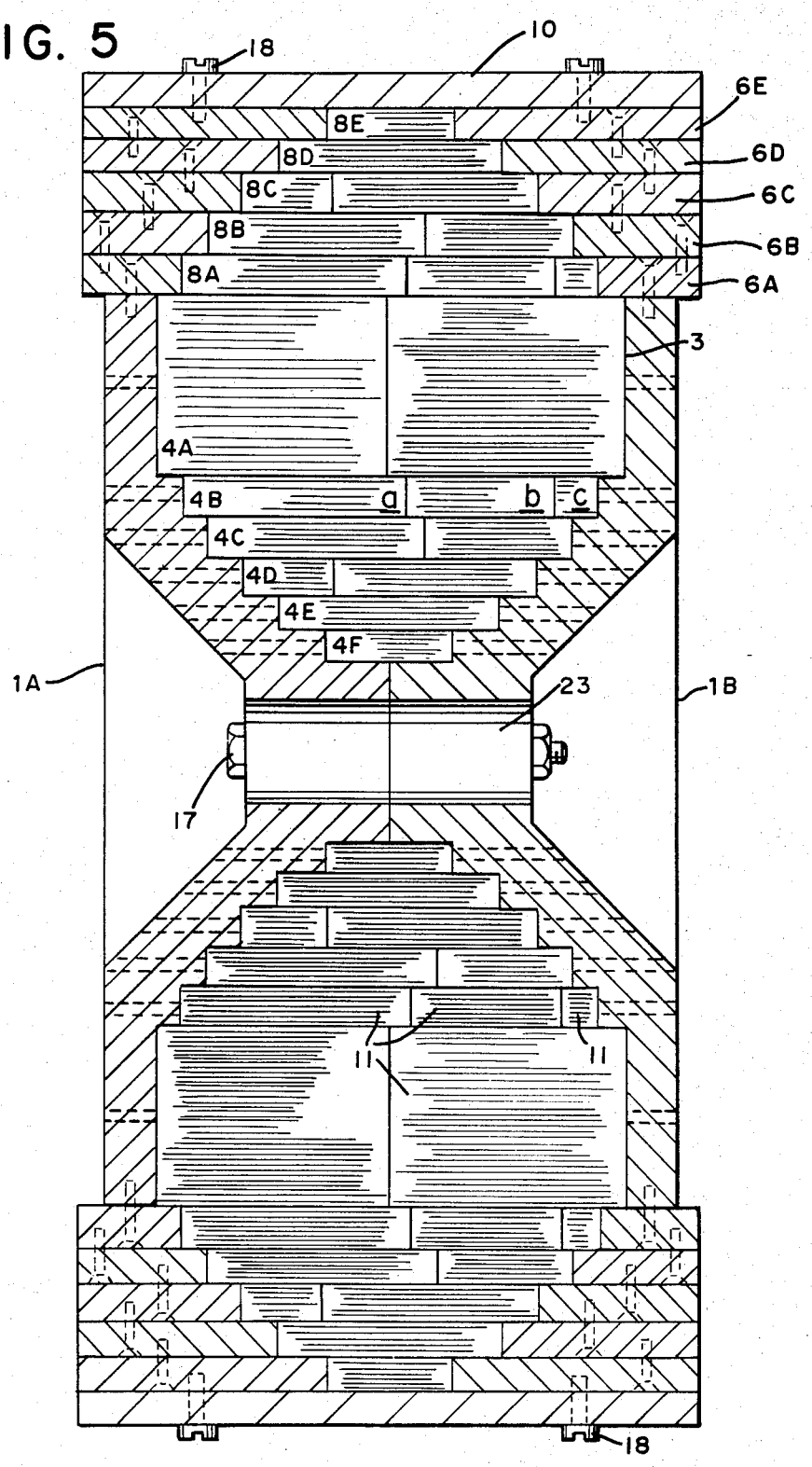
FIG. 5 is a cross-sectional view of a mandrel with templates about which multiple juxtaposed core elements have been wound.

Alternatively, the wound core can be used to produce a single loop core as representatively shown in FIG. 4. In such case, it is preferable to wind additional core elements about mandrel 1 using templates 6 which are attached at preselected locations about the periphery of mandrel 1 in complementary pairs to delimit template regions 8A therebetween. Referring to FIGS. 1 and 5, pairs of templates 6A are shown located along each of the four sides of the rectangularly shaped mandrel 1. Filament is then spirally wound around the mandrel plates on top of the previously wound core elements to fill template region 8A. Where the magnetic filament is less than the width of template region 8A, several separate juxtaposed core elements 11 are wound and positioned to fill the region with magnetic material. Even though templates 6A do not define a region which extends continuously around the mandrel, the templates sufficiently restrain the lateral movements of the wound filament to preserve the desired core contour. After region 8A is filled with magnetic material, templates 6B are attached with screws 15 to the corresponding templates 6A in complementary pairs to delimit template region 8B. Filamentary magnetic material is then spirally wound about mandrel 1 to produce juxtaposed core elements which fill template region 8B. Similarly, templates 6C are attached to corresponding templates 6B to delimit template region 8C and the template region is filled with magnetic material by spirally winding filament around mandrel 1 on top of the previously wound core elements. The process is repeated using templates 6D and E, and when all of the template regions are filled, cap plates 10 are then attached to the outer most templates with screws 18.

Whatever the chosen core configuration, it is important to anneal the wound core to relieve residual stresses within the core material caused by the winding operation. Preferably, a magnetic induction means is positioned through holes 25 and 26 to induce a circumferential magnetic field in core 7 during the annealing process to optimize the magnetic characteristics of the core.

To remove the wound core from mandrel 1, the assembly is positioned on a horizontal surface with one mandrel plate uppermost. The templates are then removed from the uppermost plate and push-out rods are inserted into push-out holes 12 to contact the core elements located thereunder. By directing a suitable force against the push-out rods while simultaneously drawing away the uppermost plate, the mandrel plate can be separated from the core without disturbing the core cross-sectional shape. The push-out rods constrain any core elements which might tend to stick to the mandrel and become drawn away with it. A suitable binding means is then employed to hold together the multiple filaments and preserve the core configuration.

EXAMPLE 1

A split mandrel 1, produced in accordance with the present invention, measured 33 cm×22.2 cm×12.7 cm. The assembled mandrel delimited an annular, stepped channel having channel regions 4A, B, C, D, E, F as representatively shown in FIG. 5. The channel regions had rectangular cross-sections with the following dimensions:

| Channel Region | Width (cm) | Depth (cm) |
|---|---|---|
| 4A | 10.185 | 3.280 |
| 4B | 8.90 | 1.300 |
| 4C | 7.645 | 0.800 |
| 4D | 6.375 | 0.555 |
| 4E | 5.080 | 0.410 |
| 4F | 2.54 | 0.490 |

Filamentary glassy metal magnetic alloy, consisting essentially of the composition 94.1% Fe, 3,35% B, 2.05% Si and 0.05% C (in weight percent), was spirally wound about mandrel 1 to produce juxtaposed core elements 11 which substantially filled the channel regions. The core elements had the following width dimensions:

| Channel Region | Element a (cm) | Element b (cm) | Element c (cm) |
|---|---|---|---|
| 4A | 5.08 | 5.08 | |
| 4B | 2.54 | 5.08 | 1.27 |
| 4C | 5.08 | 2.54 | |
| 4D | 5.08 | 1.27 | |
| 4E | 5.08 | | |
| 4F | 2.54 | | |

Templates were connected about the peripheral edge of mandrel 1 to delimit template regions 8A, B, C, D, E having rectangular cross-sections and the following dimensions:

| Template Region | Width (cm) | Height (cm) |
|---|---|---|
| 8A | 8.940 | 1.300 |
| 8B | 7.645 | 0.800 |
| 8C | 6.375 | 0.555 |
| 8D | 5.080 | 0.410 |
| 8E | 2.540 | 0.490 |

Filamentary magnetic material was spirally wound about mandrel 1 on top of the previously wound core elements to produce juxtaposed core elements which filled the template regions. The core elements had the following width dimensions:

| Template Region | Element a (cm) | Element b (cm) | Element c (cm) |
|---|---|---|---|
| 8A | 5.08 | 2.54 | 1.27 |
| 8B | 5.08 | 2.54 | |
| 8C | 5.08 | 1.27 | |
| 8D | 5.08 | | |
| 8E | 2.54 | | |

Figure 7A:
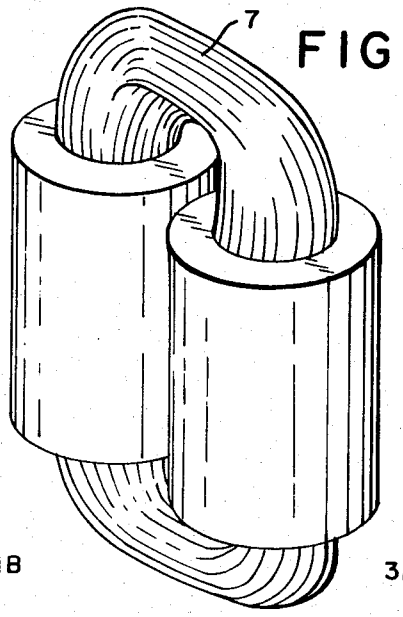
FIGS. 7A and B show representative power transformers maufactured using magnetic cores produced in accordance with the invention.
Figure 8:
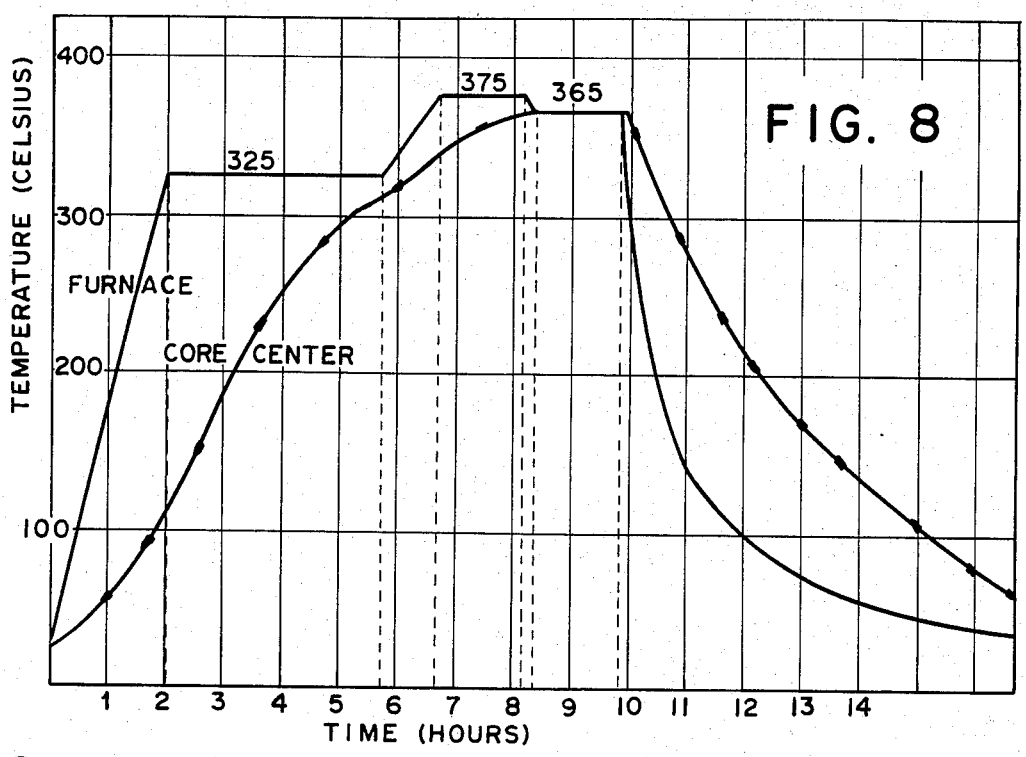
FIG. 8 shows the annealing temperature profile for the 10 KVA transformer core produced in accordance with the invention.

The wound core was annealed according to the anneal profile shown in FIG. 8 under a magnetic field of 10 Oe, and then used to produce a 10 KVA power transformer, as representatively shown in FIG. 7A. The measured core power loss of this 10 KVA transformer was about one-third the core loss of an ordinary transformer constructed from crystalline magnetic metals using conventional methods and apparatus.

EXAMPLE 2

Two, split mandrels, produced in accordance with the invention, each measured 46.99 cm×25.4 cm×18.42 cm. Each assembled mandrel delimited an annular, stepped channel having channel regions 4A, B, C, D, E, F. The channel regions had rectangular cross-sections of the following dimensions:

| Channel Region | Width (cm) | Depth (cm) |
|---|---|---|
| 4A | 15.290 | 2.65 |
| 4B | 12.750 | 2.30 |
| 4C | 11.480 | 0.70 |
| 4D | 8.940 | 1.00 |
| 4E | 6.375 | 0.65 |
| 4F | 2.540 | 0.55 |

Filamentary glassy metal magnetic alloy, consisting essentially of the composition 94.1% Fe, 3.35% B, 2.05% Si and 0.05% C (in weight percent), was spirally wound about the mandrels to produce juxtaposed core elements which filled the channel regions. The core elements had the following width dimensions:

| Channel Region | Element a (cm) | Element b (cm) | Element c (cm) |
|---|---|---|---|
| 4A | 5.08 | 5.08 | 5.08 |
| 4B | 5.08 | 5.08 | 2.54 |
| 4C | 5.08 | 5.08 | 1.27 |
| 4D | 5.08 | 2.54 | 1.27 |
| 4E | 5.08 | 1.27 | |
| 4F | 2.54 | | |

Figure 7B:
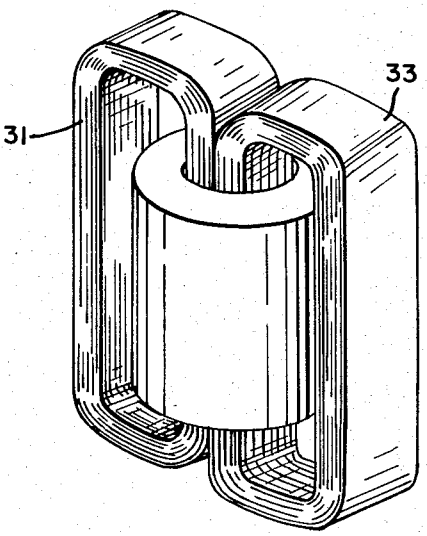
Figure 9:
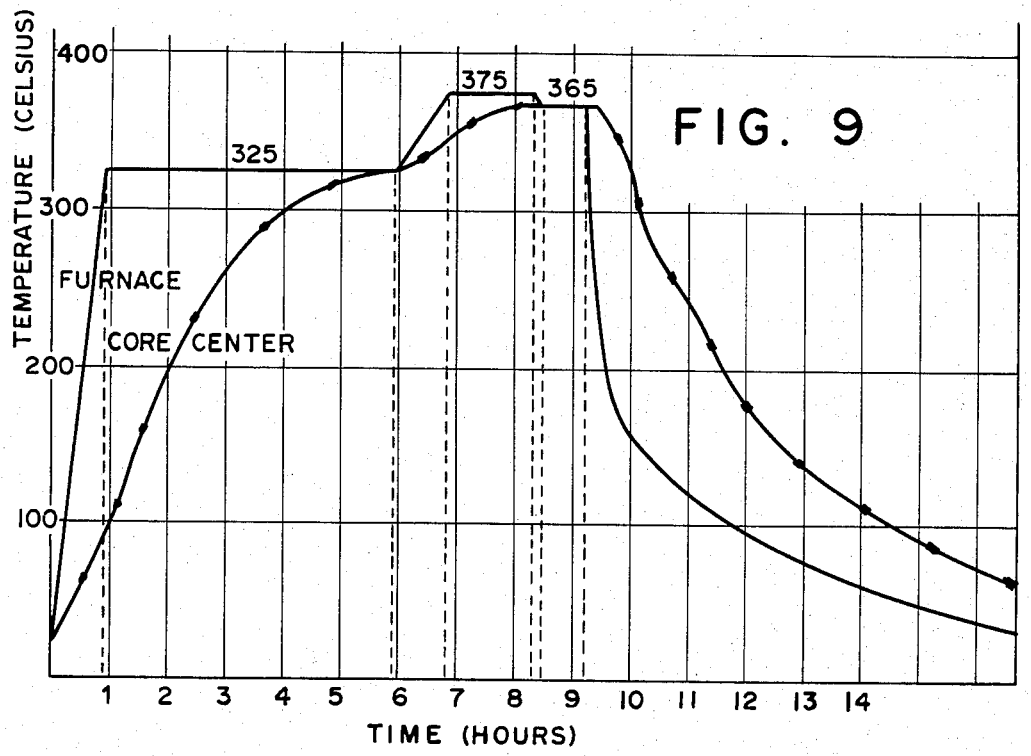
FIG. 9 shows the annealing temperature profile for the 30 KVA transformer core produced in accordance with the invention.

Each wound core was annealed according to the anneal profile shown in FIG. 9 under a magnetic field of 10 Oe. The two cores were then mated together along their complementary length dimensions and attached with suitable binding means to produce a double loop core. As representatively shown in FIG. 7B, the double loop core was used to produce a 30 KVA power transformer in which the measured core loss was approximately $\frac{1}{3}$ the core loss of an ordinary transformer constructed from crystalline magnetic core material using conventional methods and apparatus.

Having thus described the invention in rather full detail, it will be understood that these details need not be strictly adhered to but that various changes and modifications may suggest themselves to one skilled in the art, all falling within the scope of the invention as defined by the subjoined claims.

I claim:

1. A fixturing apparatus for spirally winding a magnetic core from at least one filament of magnetic material, comprising:

a. two congruent mandrel plates mated in facing relation to each other to form a split mandrel having an outer peripheral edge portion;

b. said edge portion having an annular channel formed therein to delimit at least one channel region having a preselected, characteristic width dimension; and c. a plurality of templates disposed about said edge portion in complementary pairs to delimit at least one template region having a preselected characteristic width dimension.

2. An apparatus as recited in claim 1, wherein said channel has a contoured, cross-sectional shape and delimits successive channel regions located at successively greater depths into said edge portion, each channel region having a characteristic width dimension which respectively decreases by a preselected increment in correspondence with the successively greater depth at which each successive channel region is located into said edge portion.

3. An apparatus as recited in claim 1, wherein:

a. said channel has a contoured, cross sectional shape and delimits successive channel regions located at successively greater depths into said edge portion, each channel region having a characteristic width dimension which respectively decreases by a preselected increment in correspondence with the successively greater depth at which each successive channel region is located into said edge portion; and b. said templates are graduated and located at successively greater radial distances from said edge portion to delimit successive template regions, each of said template regions having a characteristic width dimension which respectively decreases in correspondence with the successively greater radial distance at which each successive template region is located from said edge portion.

4. An apparatus as recited in claim 1, further comprising push-out means for preserving the configuration and shape of the core while removing said mandrel from said core.

5. An apparatus as recited in claim 4, further comprising apertures through said mandrel plates which accept a magnetic induction means placed there through for inducing a magnetic field in said core while said core is annealed.

6. A fixturing apparatus for spirally winding a magnetic core, which has a stepped cross-section, from a plurality of filaments of magnetic material, comprising:

a. two congruent mandrel plates mated in facing relation to each other to form a split mandrel having an outer peripheral edge portion;

b. said edge portion having an annular channel formed therein, into which said filaments are to be wound;

c. said channel having a stepped cross-sectional shape which delimits successive channel regions located at successively greater depths into said edge portion with each channel region having a characteristic width dimension which respectively decreases by a preselected increment in correspondence with the successively greater depth at which each successive channel region is located into said edge portion; and d. a plurality of templates disposed about said edge portion in complementary pairs to delimit at least one template region having a preselected characteristic width dimension.

7. An apparatus as recited in claim 6, wherein said templates are graduated and located at successively greater radial distances from said edge portion to delimit successive template regions, each of said template regions having a characteristic width dimension which respectively decreases in correspondence with the successively greater radial distance at which each successive template region is located from said edge portion.

8. An apparatus as recited in claim 6, wherein said mandrel plates have holes extending therethrough which accommodate the insertion of rods to contact wound core elements located thereunder.

* * * * *